US009638489B1

(12) United States Patent
Long

(10) Patent No.: US 9,638,489 B1
(45) Date of Patent: May 2, 2017

(54) BOW STRING RELEASE

(71) Applicant: Robert M. Long, Mokelumne Hill, CA (US)

(72) Inventor: Robert M. Long, Mokelumne Hill, CA (US)

( * ) Notice: Subject to any disclaimer, the term of this patent is extended or adjusted under 35 U.S.C. 154(b) by 0 days.

(21) Appl. No.: 14/608,129

(22) Filed: Jan. 28, 2015

Related U.S. Application Data

(60) Provisional application No. 61/937,418, filed on Feb. 7, 2014.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
USPC ..... 124/35.2
See application file for complete search history.

(56) References Cited

U.S. PATENT DOCUMENTS 2,977,952 A 4/1961 Gabriel et al.
3,800,774 A 4/1974 Troncoso
3,845,752 A 11/1974 Barner
4,009,703 A 3/1977 Cunningham, Sr.
4,672,945 A 6/1987 Carlton
4,674,469 A * 6/1987 Peck ..... F41B 5/1438 124/32
4,881,516 A * 11/1989 Peck ..... F41B 5/1469 124/35.2
5,067,472 A * 11/1991 Vogel ..... F41B 5/1469 124/35.2
5,205,268 A * 4/1993 Savage ..... F41B 5/14 124/24.1
5,224,463 A * 7/1993 Townsend ..... F41B 5/1469 124/31
5,243,957 A * 9/1993 Neilson ..... F41B 5/10 124/25.6
5,318,004 A * 6/1994 Peck ..... F41B 5/1469 124/35.2
5,448,983 A * 9/1995 Scott ..... F41B 5/1469 124/35.2
5,494,023 A * 2/1996 Kolak ..... F41B 5/1469 124/32
5,575,269 A * 11/1996 Harklau ..... F41B 5/1469 124/32
5,941,225 A * 8/1999 Tentler ..... F41B 5/1469 124/35.2
6,058,920 A * 5/2000 Tentler ..... F41B 5/1469 124/35.2

(Continued)

*Primary Examiner* — Alexander Niconovich
(74) *Attorney, Agent, or Firm* — Albert W. Watkins

(57) ABSTRACT

A bow string release has a housing encasing a battery, circuit board, mechanical linkage, and a trigger to actuate the mechanical linkage. The trigger and circuit board operatively energize an electro-mechanical device such as a solenoid, which produces linear motion. A roller terminating the solenoid engages a pivotal drive cam to convert the linear motion into rotary motion. A follower link couples the pivotal drive cam to a string hook. Proper arrangement of the linkages ensures a slight over-center biasing of the linkages to securely hold a bow string, while also ensuring that only a minimal force generated by the solenoid will be required to release the string.

17 Claims, 5 Drawing Sheets

(56) References Cited

U.S. PATENT DOCUMENTS

| | | | | |
|---|---|---|---|---|
| 6,247,467 | B1 * | 6/2001 | Siegfried | F41B 5/1469 124/35.2 |
| 6,484,710 | B1 * | 11/2002 | Summers | F41B 5/1469 124/35.2 |
| 6,606,984 | B2 * | 8/2003 | Mugg | F41B 5/1469 124/35.2 |
| 6,763,819 | B2 * | 7/2004 | Eckert | F41B 5/1469 124/35.2 |
| 6,766,794 | B1 * | 7/2004 | Bently | F41B 5/1469 124/32 |
| 8,402,957 | B1 * | 3/2013 | Clark | F41B 5/1469 124/35.2 |
| 8,453,632 | B2 * | 6/2013 | Immesberger | F41B 5/1461 124/1 |
| 8,931,466 | B2 * | 1/2015 | Immesberger | F41B 5/1461 124/23.1 |
| 9,163,897 | B1 * | 10/2015 | Estridge | F41B 5/1469 |
| 2002/0162546 | A1 * | 11/2002 | Mugg | F41B 5/1469 124/35.2 |
| 2013/0174820 | A1 * | 7/2013 | Jones | F41B 5/1469 124/35.2 |
| 2013/0220292 | A1 * | 8/2013 | Song | F41B 5/1469 124/35.2 |

* cited by examiner

BOW STRING RELEASE

CROSS REFERENCE TO RELATED APPLICATIONS

The present application claims the benefit of U.S. provisional patent application 61/937,418 filed Feb. 7, 2014 of like title and inventorship, the teachings and entire contents which are incorporated herein by reference.

BACKGROUND OF THE INVENTION

1. Field of the Invention

This invention pertains generally to mechanical guns and projectors, and more particularly to electrical trigger or releasing mechanisms designed for archery.

2. Description of the Related Art

In the field of archery, a bow has a frame or body that might, for exemplary purposes, comprise a flexible piece of wood or fiber composite. A string spans some portion of the frame. Traditional bow frames may be simple single pieces of wood that are relatively straight or slightly curved, and then bent further under the tension of a string extending generally from tip to tip. The bending of the wood provides a force opposed to the string tension. When the string is drawn, the wood flexes, with the wood acting as a simple spring. Consequently, as the string is drawn, the tension in the string increases progressively. This type of bow, which is still well known and used today, may typically require relatively great draw force. Further, holding the bow at full draw can require great strength and endurance.

There have been many types of bows that have been developed since the advent of the first straight bows, including recurve bows, reflex bows, decurve bows, deflex bows, and the much more recent compound bows. Likewise, there have been many materials used in the fabrication of bows over the years, including but not limited to wood, metal, laminates, and composites. These bows may be designed to have different draw forces and draw lengths. The draw force may range from only a few pounds for a small child's bow to one or even several hundred pounds for very powerful and specialty bows.

A common requirement among many of the bows is the need to manually grasp the bow string when drawing the string, and then to release the string to shoot the arrow. The relatively large draw forces and the relatively small diameter bow string combine to stress the relatively softer and more tender finger tips of the archer, particularly where a bow must be drawn and held for longer time periods. Archers through time have commonly employed various finger coverings such as leather to reduce the direct wear, abrasion, and disruption of circulation in their fingers.

Further, the release of the arrow has also been a form of art. A clean string release will allow the arrow to travel straight and true. However, if the archer slides the string sideways during release, the arrow flight may be slightly distorted, making the shot direction less predictable, reliable, and repeatable.

One slightly divergent technology is that of the crossbow, which addresses several of the challenges that archers may have with other bow types. One advantage of a crossbow is that there is typically some type of nut or other apparatus that is used to hold and eventually release the string. This means that the archer may hold the shot indefinitely without physical fatigue. Further, there is no abrasion to the fingers. In addition, when properly designed, a bolt, arrow, or other projectile will predictably release from the string, since the archer does not directly grasp the string.

Another challenge faced by archers is commonly referred to as target anxiety. This target anxiety may be manifested by an archer flinching or moving just as the string is being released, leading to inaccurate shots. Target anxiety can affect even the most highly skilled and experienced archers.

Over the years, a number of highly skilled artisans have devised various apparatus to effect better holding and release of the bow string. Exemplary mechanical devices, the teachings and contents which are incorporated herein by reference, include: U.S. Pat. No. 2,977,952 by Gabriel et al, entitled "Archery bow trigger"; U.S. Pat. No. 3,800,774 by Troncoso, entitled "Archery bow string release device"; U.S. Pat. No. 3,845,752 by Barner, entitled "Combined bowstring draw and trigger release mechanism for use in archery"; U.S. Pat. No. 4,009,703 by Cunningham, Sr., entitled "Bow string trigger release mechanism"; U.S. Pat. No. 4,672,945 by Carlton, entitled "Archery trigger release mechanism"; U.S. Pat. No. 4,881,516 by Peck, entitled "Adjustable grip and trigger bow string release"; U.S. Pat. No. 6,484,710 by Summers et al, entitled "Archery finger trigger release with cocking slide"; U.S. Pat. No. 8,402,957 by Clark, entitled "Release device for archery"; and 2013/0174820 by Jones, entitled "Archery release". One of the significant challenges of a string release is the desire for a minimum movement by the archer, with minimal force applied, to effect the string release. While the aforementioned patents represent a significant advancement over the technology in place prior thereto, these prior art mechanical systems simply do not offer sufficiently minimal force and movement by the archer.

Recognizing the need for an improved string release, a few artisans have designed electrical solenoid string releases. Exemplary patents, the teachings and contents which are incorporated herein by reference, include: U.S. Pat. No. 4,674,469 by Peck, entitled "Bow string release"; U.S. Pat. No. 5,243,957 by Neilson, entitled "Archery apparatus"; U.S. Pat. No. 5,494,023 by Kolak, entitled "Bow string releasing apparatus"; and U.S. Pat. No. 5,575,269 by Harklau, entitled "Bowstring release mechanism". Two additional patents, illustrating electrically driven releases but without a solenoid, the teachings and contents which are incorporated herein by reference, include: U.S. Pat. No. 6,247,467 by Siegfried, entitled "Bowstring release mechanism"; and U.S. Pat. No. 6,766,794 by Bently, entitled "Device for hands-free firing of projectile device".

Many of the prior art releases have a pivoting member that is locked in place prior to release, and then allowed to rotate freely upon release. Unfortunately, with the substantial force and rapid movement of the bow string, this can and often does lead to a slapping or slamming of the pivotal member when it reaches a stop or rotary limit. Exemplary of the prior art is the Peck '469 patent incorporated by reference herein above. In Peck, the sear 22 has a "j" shape, and pivots about pin 24. When plunger 26 is moved out of the way, sear 22 will rotate with violent force. Not only is this additional sound undesirable, since it can forewarn and thereby spook game, it can lead to undesirable wear and damage of the apparatus over a relatively short period.

Another issue is the relatively large force that is applied by the string to the release. This force will be coupled through linkages that, under load, may bind or wear excessively. Once again, the Peck '469 patent incorporated by reference herein above is exemplary of the prior art. On the longer finger 20 of Peck's sear 22, the bow string will be pulling. This force is offset by a force between the shorter leg of Peck's sear 22 and plunger 26. As may be recognized, this causes significant friction between Peck's sear 22 and plunger 26, the friction making it harder to release plunger 26 and also leading to galling and wear of both Peck's sear 22 and plunger 26. Similar deficiency is found in both Harklau and Kolak.

Further, many of these prior art devices are not automatically resetting. Again referencing the Peck design, the archer must activate the solenoid, pivot the sear 22 into place around the spring, and then release the solenoid. This resetting sequence is an undesirable, unnecessary and challenging test of manual dexterity. Once again, similar deficiency is found in both Harklau and Kolak.

Neilson in FIGS. 13-15 illustrates a different type of string release, using a solenoid and cam to wedge between two pivoting arms. This causes the arms to either open when not wedged, or close when wedged by the solenoid cam. Unfortunately, the greater the draw force, the more likely the string is to accidentally release. Further, not only are manufacturing tolerances an issue, so is wear to the various components, which will worsen the ability of the device to hold a bow string. Consequently, Neilson has the potential for accidental and unintended releases that can be very dangerous in the field.

In addition to the foregoing patents, Webster's New Universal Unabridged Dictionary, Second Edition copyright 1983, is incorporated herein by reference in entirety for the definitions of words and terms used herein.

SUMMARY OF THE INVENTION

In a first manifestation, the invention is a bow string release. A housing anchors a drive cam fixed pivot. A drive cam is rotatable about the drive cam fixed pivot. A linear motor is operatively actuated by a trigger. A reciprocating piston has a first end coupled with and moved by the linear motor, and a second end distal to the first end is adapted to operatively couple with the drive cam and adapted to operatively rotate the drive cam about the drive cam fixed pivot, responsive to the piston first end being moved by the linear motor. A string hook fixed pivot is also anchored to the housing. A string hook is adapted to operatively engage a bow string and transmit a draw force to the bow string. A follower link has a first floating pintle pivotally coupling adjacent a first end to the drive cam and a second floating pintle pivotally coupled adjacent a second end distal to the link first end to the string hook. The string hook is rotated about the string hook fixed pivot responsive to the piston first end being moved by the linear motor.

In a second manifestation, the invention is a bow string release having a housing. A string hook is adapted to operatively engage a bow string and transmit a draw force to the bow string. An electrical power source is coupled with an electrical solenoid having a reciprocating piston and an electromagnetic coil. The electrical solenoid is adapted to operatively generate reciprocating mechanical movement of the reciprocating piston when the electromagnetic coil is energized by the electrical power source. The reciprocating piston is coupled to the string hook and adapted to operatively pivot the string hook and thereby discharge a bow string therefrom. A trigger is adapted to operatively selectively connect the electrical power source with the electromagnetic coil. The reciprocating piston has a roller on a first end most nearly adjacent to the string hook, and distal to the reciprocating piston first end, a shoe bottom is adapted to engage with the housing to limit travel of the reciprocating piston towards the solenoid electromagnetic coil.

In a third manifestation, the invention is a method of releasing a bow string. The method includes the steps of: detecting a trigger pull representative of an intent to release the bow string; determining a firing option from the group of fire on trigger pull, fire on trigger release, and random delay; and energizing an electro-magnetic actuator operative to trigger bow string release after a time interval subsequent to trigger pull detection, the time interval adjusted based upon the firing option determination.

OBJECTS OF THE INVENTION

Exemplary embodiments of the present invention solve inadequacies of the prior art by providing a bow string release having a housing encasing a battery, circuit board, mechanical linkage, and a trigger to actuate the mechanical linkage. The mechanical linkage has a plurality of pivotal couplings that permit low-friction and smooth operation. The trigger and circuit board operatively energize an electromechanical device such as a solenoid, which produces linear motion. A roller terminating the solenoid engages a pivotal drive cam to convert the linear motion into rotary motion. Proper arrangement of the linkages ensures a slight over-center biasing of the linkages to securely and reliably hold a bow string, while also ensuring a minimal force to release the string. The present invention and the preferred and alternative embodiments have been developed with a number of objectives in mind. While not all of these objectives are found in every embodiment, these objectives nevertheless provide a sense of the general intent and the many possible benefits that are available from embodiments of the present invention.

A first object of the invention is to provide smooth, uniform, reliable, controlled and silent or very quiet string release. A second object of the invention is to provide a simple to use, easy to engage, auto-resetting, ambidextrous string release that provides both right and left-handed archers with the ability to hold a string in drawn position. Another object of the present invention is to enable an archer to hold a string without significant abrasion or disruption of circulation in the finger tips. A further object of the invention is to provide a bow string release having a release sensitivity independent of bow pull force, string characteristics and other similar variable parameters. Yet another object of the present invention is to provide an archer the option to select string release on trigger pull, string release on trigger release, or delayed string release to help reduce target panic. An additional object of the invention is to provide a small, rugged and reliable, light weight, easily carried upon a lanyard, and economical to manufacture bow string release.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which:

FIG. 5 illustrates the first alternative embodiment bow string release of FIG. 3 from an enlarged top view, showing only the string hook, follower link, drive cam, and pivots there between.

DESCRIPTION OF THE PREFERRED EMBODIMENT

Figure 1:
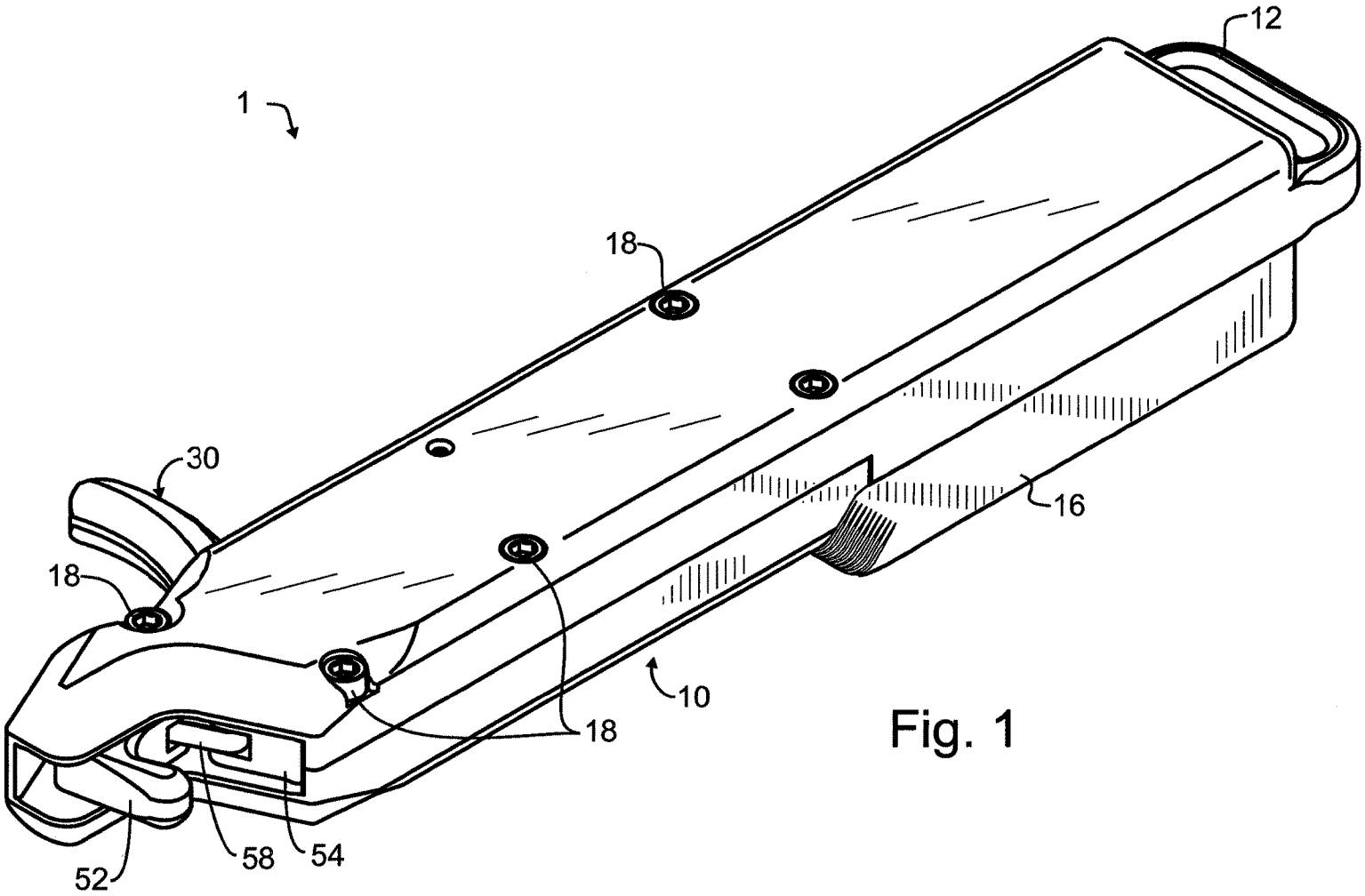
FIG. 1 illustrates a preferred embodiment bow string release designed in accord with the teachings of the present invention from a projected view.
Figure 2:
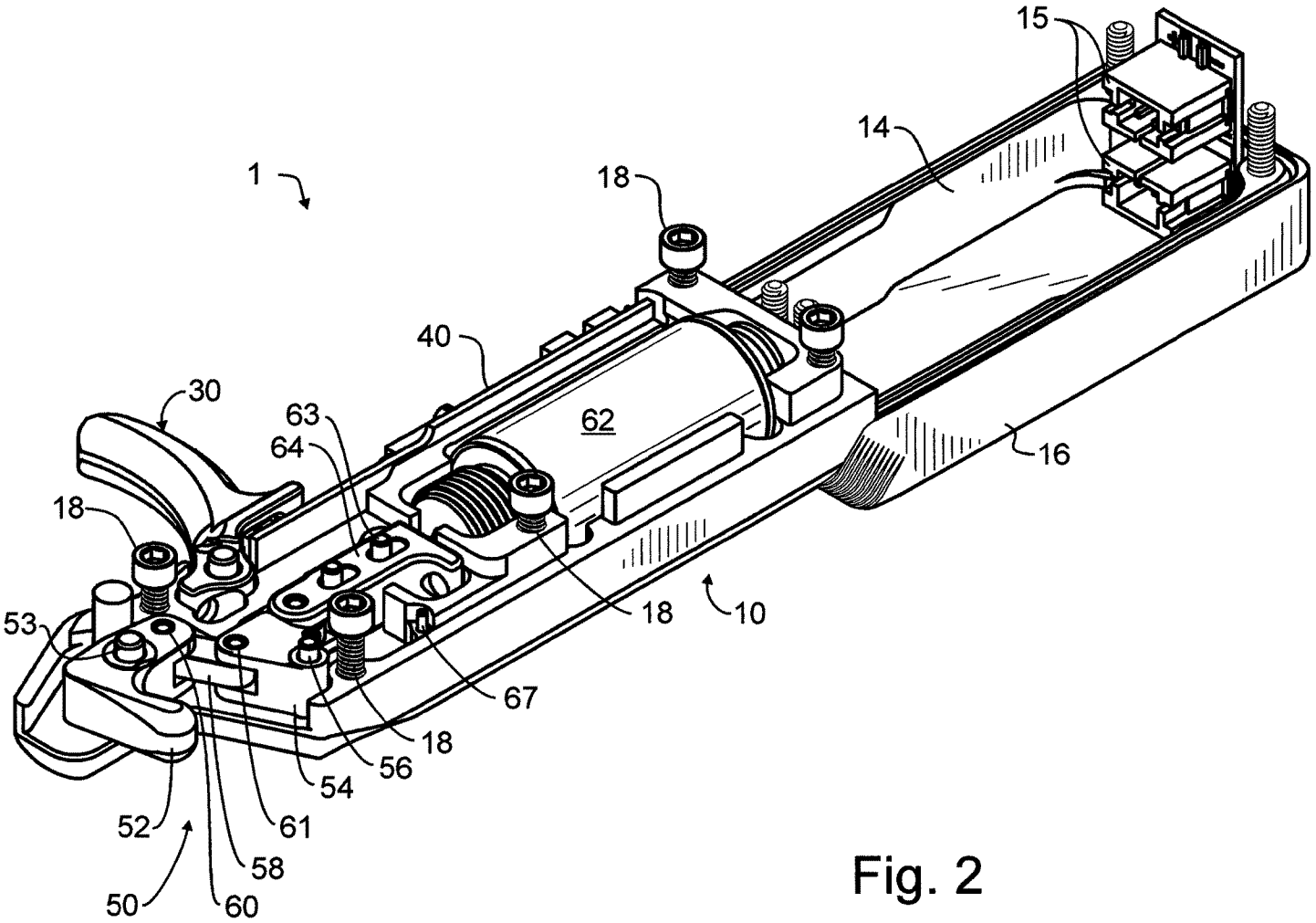
FIG. 2 illustrates the preferred embodiment bow string release of FIG. 1 with the top portion of the clamshell housing removed to reveal inner components, and with a select few other components removed, from a projected view similar to that of FIG. 1.

In a preferred embodiment of the invention illustrated in FIGS. 1 and 2, and with particular reference to FIG. 1, a bow string release 1 is comprised of a housing 10 that may be readily manually grasped, such as the clamshell housing 10 illustrated therein, though any suitable housing may be provided. The top and bottom portions of clamshell housing 10 are secured to each other using a plurality of socket head cap screws 18, though any suitable fasteners, including permanent fasteners and adhesives, may be used.

A trigger 30 may be provided at any suitable location, though in the preferred embodiment, trigger 30 is located at a position that will be conveniently actuated by a thumb or finger. A string hook 52 will engage the bow string, while a drive cam 54 and follower link 58 will move string hook 52 from a string-retaining position as shown in the drawing figures to a string-release position and back again. Trigger 30, which may be of any geometry or structure, is used by an archer to selectively control the movement of string hook 52. Consequently, any apparatus that detects an intent by an archer to release the string will be understood herein to be a trigger in accord with the teachings of the present invention.

A lanyard connection 12 or the like is preferred. As will be understood, a bow string release such as illustrated herein may be accidentally dropped. While it may be possible to construct all of the components sufficiently to withstand a drop onto a hard surface, a lanyard will be much less expensive and generally very convenient for most archers. A lanyard connection 12 may be provided at any suitable location, and in the preferred embodiment is located at an end of bow string release 1 distal to string hook 52.

A battery cap 16 will preferably provide closure about and access to a battery compartment 14 visible in FIG. 2. FIG. 2 illustrates bow string release 1 with one side of clamshell housing 10 removed, but with battery cap 16 still in place. Within battery compartment 14 are a pair of battery connectors 15 that allow relatively simple battery connection and disconnection. In the preferred embodiment of FIGS. 1 and 2, a relatively large battery 20 is provided, though it will be understood that any suitable source of electrical energy may be used. Battery 20 may be easily accessed separately and independently from the remaining components by removal of battery cap 16, though there is no requirement that this be the case.

When a person operates trigger 30, they will do so by pivoting trigger 30 about trigger pivot 32, which in turn applies a compressive force to micro-switch actuator 36. Sufficient trigger rotation will actuate micro-switch 34, producing an indication that the archer would like to initiate a string release cycle. Trigger 30 will preferably not be attached loosely, and so may be securely coupled to micro-switch actuator 36. A secure coupling might be a direct bonding or affixing of trigger 30 to micro-switch actuator 36. In a first alternative, the range of rotation of trigger 30 may be set such that trigger 30 cannot rotate away from micro-switch actuator 36. In a further alternative, there may be provided a relatively soft spring biasing trigger 30 towards micro-switch 34. In the case of a soft spring, the bias spring must be of lower force than necessary to actuate micro-switch 34.

Micro-switch 34 is mounted upon and electrically coupled to circuit board 40 provided in the preferred embodiment bow string release 1. Circuit board 40 will preferably be populated with various electronic components that enable various electrical and electronic control functions to be implemented. These components may take many forms and configurations, as is known in the electrical arts, implemented as electronic hardware, software stored on a computer readable medium and executable by a processor, or combinations of both. The various functions described in connection with the embodiments disclosed herein may be implemented or performed with a general purpose processor, a reduced instruction set computing processor (RISC), a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, micro-controller, or state machine. A processor may also be implemented as a combination of computing devices, e.g., a combination of a DSP and a microprocessor, a plurality of microprocessors, one or more microprocessors in conjunction with a DSP core, or any other such configuration. Whether such functionality is implemented as hardware or software depends upon the particular application and design constraints.

In the preferred embodiment, an archer may select when string hook 52 will release. This is preferably achieved through an interaction between trigger 30, circuit board 40, and mechanical linkage 50. A first option is to trigger release of the string from string hook 52 when trigger 30 is pulled, which corresponds with the closing of micro-switch 34. A second option is to trigger the release of the string from string hook 52 when trigger 30 is released subsequent to being pulled. Third and fourth options are to trigger the release of the string at some delayed time interval after either the pull or alternatively the release of trigger 30. Yet another set of options include the triggering at random time intervals subsequent to the pull or release of trigger 30. Where an archer is simply preserving their fingers, they may opt for immediate release of the string responsive to either the pull or release of trigger 30, depending upon their personal preference. However, where target anxiety is a factor, a delay time interval or a random delay time interval may be preferred by the archer.

Electrical control of the release of the string from string hook 52 occurs through a combination of a source of electrical energy such as a battery 20 located within battery compartment 14, electrical circuitry on circuit board 40, and an electro-mechanical device such as solenoid 62 converting the electrical energy to mechanical motion. When electrically activated, solenoid 62 will drive solenoid piston 64 forward from the solenoid toward string hook 52. The amount of time that solenoid 62 is energized is referred to as the dwell time. In the preferred embodiment, the dwell time is adjustably controlled by the electrical circuitry on circuit board 40, and so may be set or adjusted to accommodate the needs of particular mechanical components, bow draw force, and any other factors that might affect how much dwell time is required. For exemplary purposes, and not solely limiting the present invention thereto, the dwell time may only be a few milliseconds as will be further explained herein below.

After solenoid 62 has been energized, solenoid piston 64 in turn pushes on drive cam 54, and, as may be appreciated from FIG. 2, drive cam 54 will rotate about drive cam fixed pivot 56. Fixed pivot 56 is described as a fixed pintle owing to the actual anchoring or fixing into housing 10. Drive cam 54 is coupled to follower link 58 through a floating pin 61 that permits rotation there between. Floating pin 61 is not anchored to housing 10, and so is free to move or float relative thereto.

In the process of rotating, drive cam 54 will then move follower link 58 in an arc about drive cam fixed pivot 56. This motion causes follower link 58 to pull on a floating pivot 60 that couples follower link 58 to string hook 52, in turn causing string hook 52 to rotate about string hook fixed pivot 53. This rotation of string hook 52 is what ultimately releases the bow string from string hook 52. In this preferred embodiment, an arrow nocked on the bow string will be pulled and released generally in a direction parallel to the longitudinal axis of the preferred bow string release.

In the preferred embodiment, solenoid piston 64 is always in contact with drive cam 54. However, the invention is not solely limited thereto. Instead, in an alternative embodiment a stop could, for exemplary purposes, be provided to limit the rotation of drive cam 54. In this case, then the retraction of solenoid piston 64, which can be initiated either by return spring 68 or by a return spring internal to solenoid 62, can lead to the formation of a gap between piston roller 65 and solenoid piston 64. A drawback of this alternative embodiment is the tendency for solenoid piston 64 to slap when driven into contact with drive cam 54. However, slap can be mitigated through sound-dampening materials. The benefit of this alternative embodiment is the additional kinetic energy from the momentum of solenoid piston 64 that can generate a greater initial force upon drive cam 54.

In the preferred embodiment, each of the four pintles, including string hook pivot 53, drive cam fixed pivot 56, and floating pivots 60, 61 create a center of rotation, which in turn defines an axis of rotation. All four axes are preferably parallel to one another, which prevents interference and binding that might otherwise occur.

Figure 5:
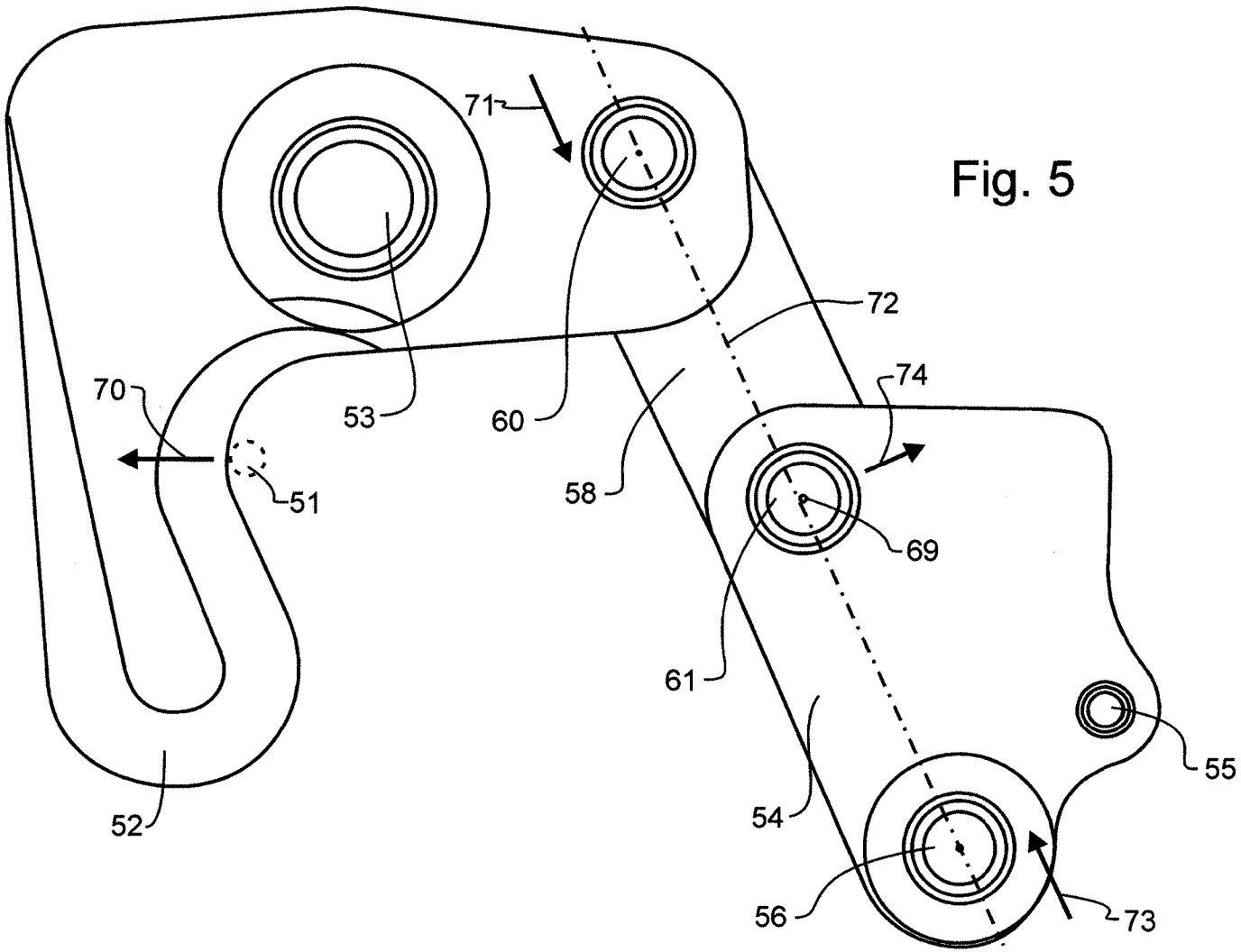

When a bow string 51 illustrated in FIG. 5 is pulled upon by string hook 52, the force vector 70 of string 51 if unopposed would cause string hook 52 to rotate in a clockwise direction about string hook pivot 53 and release the string. However, with proper dimensioning, in the position illustrated in FIG. 3 floating linkages 60, 61 and drive cam fixed pivot 56 are not quite in line. As best illustrated in FIG. 5, there is a slight "V" shape. A plane 72 contains the rotational axes of pivots 56, 60. However, the axis of rotation 69 of floating pivot 61 is slightly offset from plane 72 in a direction closer to solenoid 62. This means that force vector 70 generated upon string hook 52 by the pull upon bow string 51 will produce a force vector 71 tending floating pivot 60 towards drive cam fixed pivot 56. Since drive cam fixed pivot 56 is fixed with respect to housing 10, this generates an opposed force vector 73. Any rotation of string hook 52 will then drive the axis of rotation 69 of pivot 61 to move closer to solenoid 62, shifting in the direction of and with a force defined by force vector 74. However, from FIGS. 2 and 3, it will be apparent that in the string holding position of the figures, drive cam 54 is not free to rotate.

In the de-energized position shown in the figures, piston 62 is fully retracted. Since solenoid piston 64 is boot shaped, the bottom of the boot simply presses against features formed in housing 10 as best viewed in FIG. 2. Since solenoid 62 is fully retracted and housing 10 prevents solenoid piston 64 from moving, solenoid piston 64 will generate an equal and opposite force vector to oppose force vector 74. This creates a static and strong holding force, to securely hold the bow string 51, even with extremely high draw forces. Consequently, as long as follower link 58, drive cam 54, solenoid piston 64, and housing 10 are all sufficiently durable, then a bow string release designed in accord with the teachings of the invention can be used to draw against an enormous draw force. While a boot shape is illustrated for solenoid piston 64, it will be understood that any geometry which will engage and stop at an appropriate feature in housing 10 is suitable. For exemplary purposes, and not solely limiting the invention thereto, a bell-shaped solenoid piston or other similar flared geometry would readily be substituted for boot shaped solenoid piston 64.

As understood from the foregoing, there is no electrical energy or spring force required to hold string hook 52 in the string pull position illustrated in the Figures. As long as the angle between a first line segment from the center of pivot 56 to the center of pivot 61 is offset from parallel with a second line segment from the center of pivot 60 to the center of pivot 61, and shifted so that the center of pivot 61 is slightly closer to solenoid 62 than a line from the center of pivot 56 to the center of pivot 60, then the draw force alone will hold string hook 52 in place.

When solenoid 62 is fired, it must drive axis of rotation 69 across plane 72 and closer to bow string 51. Once axis of rotation 69 crosses plane 72, then string hook 52 may rotate in a clockwise direction, essentially unopposed, for a very rapid release. The only restriction on the speed of rotation is a low-force return spring 66 shown in FIG. 3, and it is return spring 66 that will then automatically reset string hook 52 to the position of the Figures, once string 51 is released.

Consequently, solenoid 62 pushing piston roller 65 against drive cam roller face 57 must generate a force great enough to overcome force vector 74. Noteworthy here is that the closer axis of rotation 69 is to plane 72, the smaller force vector 74 will be. In other words, and again only for exemplary purposes, if axis of rotation 69 were exactly within plane 72, then all of the force opposing string hook 53 rotation will come entirely from drive cam fixed pivot 56 through force vector 73. Only in this exact case where axis of rotation 69 is exactly within plane 72, then force vector 74 is zero, meaning there is no additional force pushing back against solenoid 62. Even when axis of rotation 69 is close to plane 72, then force vector 74 will be near zero. This is important, because the amount of force required of solenoid 62 to release the bow string 51 is primarily determined by the magnitude of force vector 74. In other words, solenoid 62 can be much smaller and will draw less power if axis of rotation 69 can be kept close to plane 72. In such case, then not only is less force required, but the amount of time that solenoid 62 needs energized, referred to herein above as dwell time, is also very small. The benefit of a smaller solenoid 62 is obvious in size, weight, and cost. Not only can solenoid 62 be smaller, but the shorter dwell time also allows battery 20 to be much smaller while still providing good battery life.

At the time of design of the bow string release, the precise length of follower link 58 and the exact dimensions of drive cam 54 and string hook 52 will be determined. Furthermore, the tolerances and any play within the floating pivots 60, 61 and at the drive cam fixed pivot 56 and string hook pivot 53 will be determined. Those skilled in the arts of physics and engineering can then determine how much offset between axis of rotation 69 and plane 72 is required to ensure a safe and secure holding of bow string 51. In other words, in the hypothetical example above where axis of rotation 69 is within plane 72, a small jolt could lead to an accidental release. By providing a small force 74, accidental releases are easily prevented. Then those same persons skilled in the art of physics and engineering can easily calculate the magnitude of this force 74 for a given force vector 70, and so an appropriate solenoid 62 and battery 20 may be selected based upon the known dimensions and manufacturing tolerances.

With reasonably sturdy construction, there is no practical limit to the draw force that the invention may be used with. Instead, the limiting factor will normally be the force required to be generated by the solenoid to push axis of rotation 69 across plane 72. In order to push axis of rotation 69 across plane 72, there will be a slight counterclockwise rotation of string hook 52 just prior to string release.

As noted above, manufacturing tolerances will directly affect the strength of solenoid required. This is because the return spring will ideally lock string hook reliably and repeatedly into the position shown in the Figures. Any loose fittings or dimensional deviations will increase the amount that axis of rotation 69 must be shifted form plane 72 and still work reliably. As outlined above, the greater the shift of axis of rotation 69 from plane 72, the more powerful a solenoid that is also required.

Figure 3:
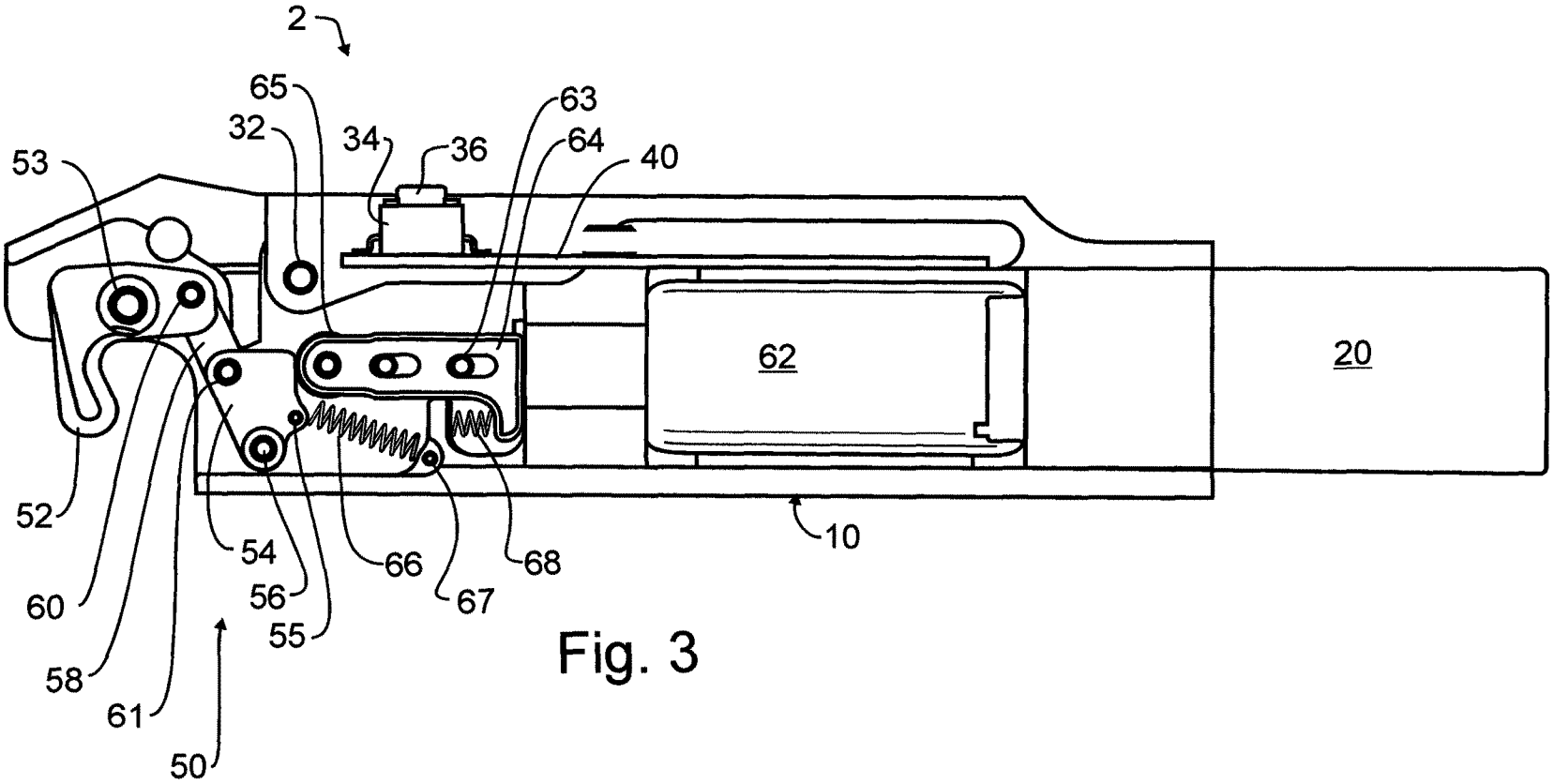
FIG. 3 illustrates a first alternative embodiment bow string release similar to that of FIG. 2 from top view and with the top portion of the clamshell housing removed, and with a select few other components removed.
Figure 4:
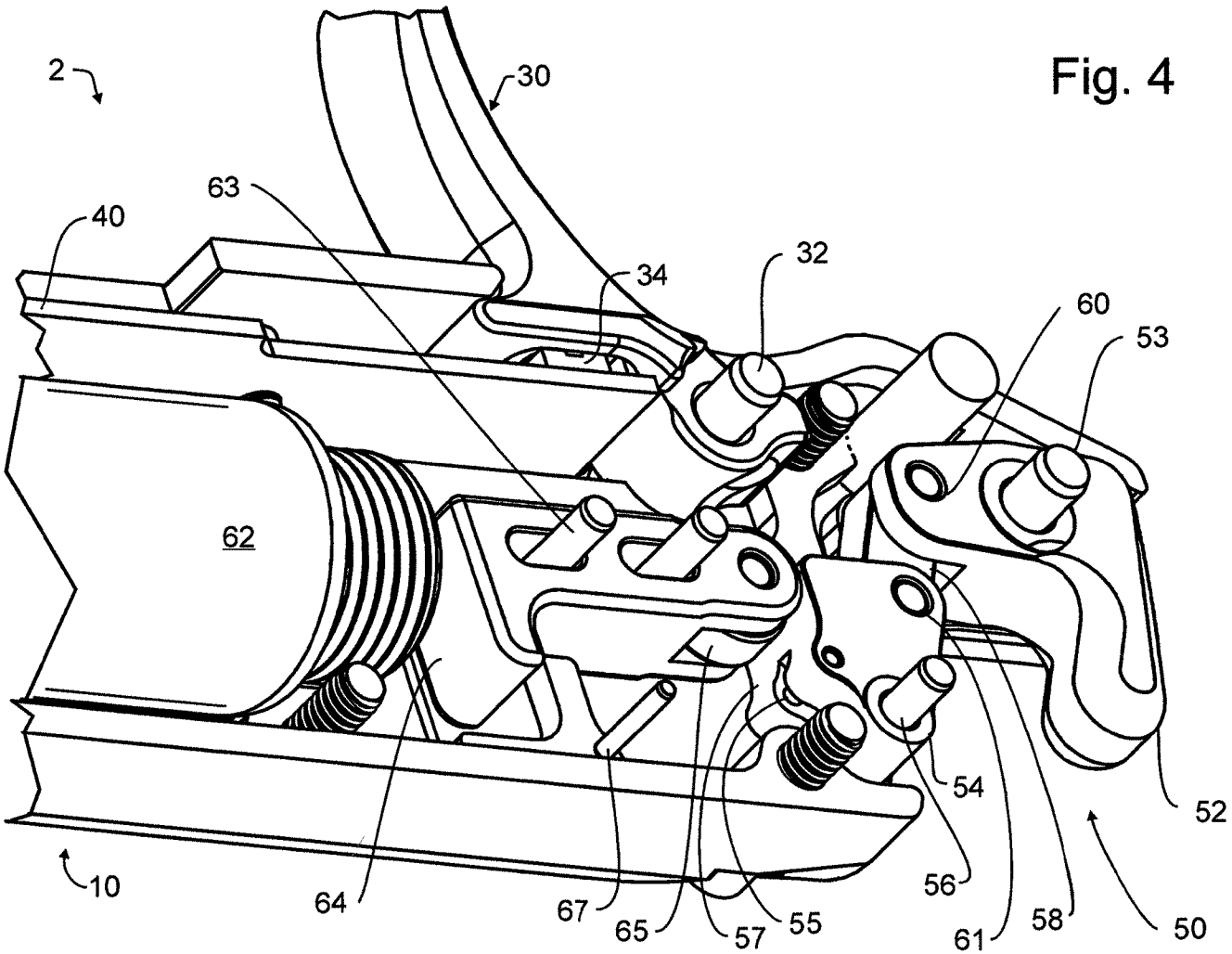
FIG. 4 illustrates the first alternative embodiment bow string release of FIG. 3 from a rear projected and enlarged view.

A significant feature of each of the embodiments of the present invention is that the string hook 52 self-resets. In other words, in the preferred and first alternative embodiment bow string releases 1, 2 of FIGS. 1-4, one or more additional return springs such as return spring 66 and solenoid piston return spring 68 may be provided, such as illustrated in FIG. 3. This is necessary because solenoid piston 64 is not affixed to the remaining linkage, and instead uses piston roller 65 to provide smooth, substantially reduced friction connection between piston roller 65 and drive cam 54. Return spring 66 is anchored at a first end to return spring fixed anchor pin 67 that is rigidly affixed into housing 10. A second distal end of return spring 66 is coupled to return spring anchor pin 55, which is rigidly affixed into drive cam 54. The arrangement of drive cam 54, drive cam roller face 57, anchor pin 55, solenoid piston 64, piston roller 65, and fixed anchor pin 67 is best illustrated in FIG. 4, which has been illustrated without return springs 66 and 68 to enable better viewing. Piston roller 65 rolls against the slightly curved drive cam roller face 57, while a slot adjacent thereto in drive cam 54 enables return spring 66 to engage with anchor pin 55.

In one alternative embodiment, solenoid piston 64 may be coupled through a floating pivot such as a pin or the like to drive cam 54. In this alternative embodiment, a return spring which is commonly a part of an electrical solenoid will pull the solenoid piston 64 back into solenoid 62 when solenoid 62 is de-energized. Return of solenoid piston 64 will reset string hook 52 to the position such as illustrated in FIG. 1, ready to be easily hooked onto a bow string and used again to draw and release the bow string.

Solenoid piston 64 may be constructed as a single integral component, typically having a cylindrical portion within the body of solenoid 62, or may be fabricated from several discrete components that are coupled together, such as in the embodiments of FIGS. 1-4. One or more piston guide pins 63 may be provided, and if so, corresponding slots are formed in solenoid piston 64 to permit solenoid piston 64 to reciprocate towards and away from drive cam 54.

String hook 52 rotates about string hook pivot 53, and when moving from the string retaining position of FIG. 3, will rotate in a clockwise direction about string hook pivot 53 to release an archery string. Bow string release 2 illustrated in FIGS. 3 and 4 is similar to bow string release 1 of FIGS. 1 and 2, and has a similar micro-switch 34, trigger pivot 32, circuit board 40, solenoid 62, solenoid piston 64, drive cam 54, follower link 58, and string hook 52. The battery 20 and housing 10 have been changed slightly, and trigger 30 is not separately illustrated. However, the string travel vector, which corresponds to the arrow travel, matches force vector 70 of FIG. 5 and is approximately in line with the longitudinal axis of first alternative embodiment bow string release 2, and operation is very similar to that of preferred embodiment bow string release 1. Nevertheless, other variants are also contemplated herein, such as a string travel vector and associated arrow travel perpendicular to the longitudinal axis of the bow string release.

From the foregoing figures and description, several additional features and options become more apparent. First of all, a bow string release designed in accord with the teachings of the present invention may be manufactured from a variety of materials, including metals, resins and plastics, ceramics or cementitious materials, or even combinations, laminates or composites of the above. The specific material used may vary as will be determined by a designer at design time. In addition, where electrical components are illustrated and preferred, it is further contemplated herein that mechanical components may be substituted therefor. One such component that is contemplated herein is the solenoid, which is contemplated as being replaced with a mechanical energy storage device, such as a spring and sear that permits a plunger to be manually drawn back and then held in place by the sear. Upon release of the sear, the plunger may then be propelled forward by the energy stored in the spring, to drive the cams and follower links, to in turn pivot the string hook about. Likewise, while a single string hook is illustrated and preferred, which permits rapid attachment to a bow string simply by hooking the string, other apparatus may be substituted therefor, such as a set of scissors-motion jaws or other apparatus.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. A bow string release, comprising:

a housing;

a drive cam fixed pivot anchored to said housing;

a drive cam rotatable about drive cam fixed pivot;

a linear motor;

a trigger adapted to operatively actuate said linear motor;

a reciprocating piston having a first end coupled with and moved by said linear motor, and a second end distal to said first end adapted to operatively couple with said drive cam and adapted to operatively rotate said drive cam about said drive cam fixed pivot responsive to said piston first end being moved by said linear motor;

a string hook fixed pivot anchored to said housing;

a string hook adapted to operatively engage a bow string and transmit a draw force to said bow string;

a follower link having a first floating pintle pivotally coupling adjacent a first end to said drive cam and a second floating pintle pivotally coupled adjacent a second end distal to said link first end to said string hook;

said string hook rotated about said string hook fixed pivot responsive to said piston first end being moved by said linear motor.

2. The bow string release of claim 1, further comprising:

a drive cam axis of rotation defined by a center of said drive cam rotation;

a second floating pintle axis of rotation defined by a center of said second floating pintle rotation;

a center plane containing both of said drive cam axis of rotation and said second floating pintle axis of rotation;

a first floating pintle axis of rotation defined by a center of said first floating pintle rotation;

said string hook having a first orientation about said string hook fixed pivot adapted to retain an archery string, and a second orientation about said string hook fixed pivot adapted to release said archery string;

said first floating pintle axis of rotation offset from said center plane and closer to said linear motor than said center plane when said string hook is in said first orientation about said string hook fixed pivot.

3. The bow string release of claim 2, further comprising:

a string hook fixed pivot axis of rotation defined by a center of said string hook fixed pivot rotation;

each of said drive cam axis of rotation, said first floating pintle axis of rotation, second floating pintle axis of rotation, and said string hook fixed pivot axis of rotation being parallel with each other.

4. The bow string release of claim 2, wherein a force generated upon said string hook by a pull upon said archery string produces a force tending said first floating pintle axis of rotation towards said linear motor.

5. The bow string release of claim 4, wherein said solenoid piston is boot shaped and has a boot bottom facing said solenoid, and said housing further comprises a stop surface adapted to operatively engage said boot bottom when said string hook is in said first orientation about said string hook fixed pivot, wherein said force tending said first floating pintle axis of rotation towards said linear motor is opposed by a force generated between said stop surface and said boot bottom, thereby operatively preventing rotation of said string hook away from said first orientation about said string hook fixed pivot.

6. The bow string release of claim 1, further comprising:

a piston roller adjacent to said reciprocating piston second end; and a drive cam roller face adjacent to and adapted to operatively engage with said piston roller.

7. The bow string release of claim 1, further comprising:

a battery;

an electronic circuit powered by said battery and coupled to said linear motor; and an electrical switch adapted to operatively actuate responsive to said trigger and coupled to said electronic circuit to cause said electrical circuit to actuate said linear motor.

8. The bow string release of claim 7, wherein said linear motor further comprises an electro-mechanical solenoid adapted to operatively convert electrical energy to mechanical motion.

9. The bow string release of claim 7, further comprising a trigger pivot about which said trigger pivots, and responsive to said trigger pivoting said trigger applies a switching force to an actuator within said electrical switch, whereby application of a sufficient switching force will actuate said electrical switch, producing an indication that the archer would like to initiate a bow string release.

10. The bow string release of claim 7, wherein said electrical switch further comprises a micro-switch, and said trigger is securely affixed to said micro-switch actuator.

11. The bow string release of claim 1, further comprising:

a return spring fixed anchor rigidly affixed to said housing;

a return spring anchor pin rigidly affixed to said drive cam;

a return spring anchored at a first end to said return spring fixed anchor and at a second distal end to said return spring anchor pin.

12. A bow string release, comprising:

a housing;

a string hook adapted to operatively engage a bow string and transmit a draw force to said bow string;

an electrical power source;

an electrical solenoid having a reciprocating piston and an electromagnetic coil coupled with said electrical power source, said electrical solenoid adapted to operatively generate reciprocating mechanical movement of said reciprocating piston when said electromagnetic coil is energized by said electrical power source;

said reciprocating piston coupled to said string hook and adapted to operatively pivot said string hook and thereby discharge a bow string therefrom;

a trigger adapted to operatively selectively connect said electrical power source with said electromagnetic coil;

said reciprocating piston having a roller on a first end most nearly adjacent to said string hook, and distal to said reciprocating piston first end a shoe bottom adapted to engage with said housing to limit travel of said reciprocating piston towards said solenoid electromagnetic coil;

a drive cam fixed pivot anchored to said housing;

a drive cam rotatable about drive cam fixed pivot;

said reciprocating piston roller adapted to operatively couple with said drive cam and adapted to operatively rotate said drive cam about said drive cam fixed pivot responsive to said piston first end being moved by said electromagnetic coil energization;

a string hook fixed pivot anchored to said housing; and a follower link having a first floating pintle pivotally coupling adjacent a first end to said drive cam and a second floating pintle pivotally coupled adjacent a second end distal to said link first end to said string hook;

said string hook rotated about said string hook fixed pivot responsive to said reciprocating piston being moved by said electromagnetic coil energization.

13. The bow string release of claim 12, further comprising:

a drive cam axis of rotation defined by a center of said drive cam rotation;

a second floating pintle axis of rotation defined by a center of said second floating pintle rotation;

a center plane containing both of said drive cam axis of rotation and said second floating pintle axis of rotation;

a first floating pintle axis of rotation defined by a center of said first floating pintle rotation;

said string hook having a first orientation about said string hook fixed pivot adapted to retain an archery string, and a second orientation about said string hook fixed pivot adapted to release said archery string;

said first floating pintle axis of rotation offset from said center plane and closer to said electrical solenoid than said center plane when said string hook is in said first orientation about said string hook fixed pivot.

14. The bow string release of claim 13, further comprising:

a string hook fixed pivot axis of rotation defined by a center of said string hook fixed pivot rotation;

each of said drive cam axis of rotation, said first floating pintle axis of rotation, second floating pintle axis of rotation, and said string hook fixed pivot axis of rotation being parallel with each other.

15. The bow string release of claim 13, wherein a force generated upon said string hook by a pull upon said archery string produces a force tending said first floating pintle axis of rotation towards said linear motor.

16. The bow string release of claim 12, further comprising:

an electrical switch having an actuator, said electrical switch electrically coupling said electrical solenoid with said electrical power source; and a trigger pivot about which said trigger pivots, and responsive to said trigger pivoting said trigger applies a switching force to said electrical switch actuator, whereby application of a sufficient switching force will actuate said electrical switch, producing an indication that the archer would like to initiate a bow string release.

17. The bow string release of claim 12, further comprising:

a return spring fixed anchor rigidly affixed to said housing;

a return spring anchor pin rigidly affixed to said drive cam;

a return spring anchored at a first end to said return spring fixed anchor and at a second distal end to said return spring anchor pin.

* * * * *